United States Patent [19]

Loper

[11] 4,398,473

[45] Aug. 16, 1983

[54] STOKER BACKSTOP

[75] Inventor: Dossie H. Loper, Mobile, Ala.

[73] Assignee: Combustion Engineering, Inc., Windsor, Conn.

[21] Appl. No.: 341,398

[22] Filed: Jan. 21, 1982

[51] Int. Cl.[3] ..... F23N 11/10

[52] U.S. Cl. ..... 110/271; 110/329

[58] Field of Search ..... 110/271, 104 R, 329, 110/257, 259

[56] References Cited

U.S. PATENT DOCUMENTS

| | | | |
|---|---|---|---|
| 2,302,173 | 11/1942 | Beers | 110/271 |
| 2,550,521 | 4/1951 | Bennett et al. | 110/271 |
| 2,804,834 | 9/1957 | Rivers | 110/271 |

*Primary Examiner*—Edward G. Favors

*Attorney, Agent, or Firm*—Arthur L. Wade

[57] ABSTRACT

A wood-burning stoker grate is provided a barrier across its rear end functioning as an impact surface for fuel and foreign matter projected toward the rear of the stoker grate. The barrier is made up of two sections, each section formed of parts with the same configuration as parts used in the stoker grate.

6 Claims, 4 Drawing Figures

STOKER BACKSTOP

TECHNICAL FIELD

The present invention relates to barrier walls mounted above the rear end of stoker grates to ensure all of the projected solid fuel and trash is confined to the grate surface. More particularly, the invention relates to barriers formed with units of the same configuration as the structural units of the stoker grate for the increased convenience in maintenance, repair, and replacement of the barrier.

BACKGROUND ART

The continuous ash discharge (CAD) stoker of solid fuel-burning furnaces has a well-established configuration in the art. Broadly, these stokers resemble catapillar treads in that they include endless belts on rollers. More specifically, the belt is made up of parallel carrier bars chained together. Each carrier bar supports a number of so-called keys which are mounted on the carrier bars side-by-side.

Together, the keys, mounted on their carrier bars, form a flat, horizontal surface on which solid fuel is projected to form a burning bed. Combustion air is directed up between the keys to sustain the combustion, and the endless belt is moved by its rollers to drop the ash of the bed from its front end, while fresh fuel is projected onto the read end.

It has been the practice to provide some form of wall, or barrier, over the rear end of the grate to prevent the projected fuel from going past the grate surface. A recent problem is generated by the decreasing quality of the solid fuel. By decreasing quality of the solid fuel it is meant that solid trash, such as metallic objects, concrete blocks, etc. are not cleaned from the solid fuel. When the fuel of this poor quality is projected from the front of the furnace over the grate, the non-combustible, solid trash may be hurtled with destructive force against the prior art barriers. The deterioration of the prior art barriers includes breakage, the portions of the deteriorating barrier, as well as the solid non-combustibles, being dropped onto the grate, creating further damage. When subjected to this form of cannonading, the expensive barrier and grate structures can require extensive maintenance, repair, and replacement. What is needed is a barrier structure whose parts, to be maintained, repaired, and replaced, have the configuration of the parts available for the grate structure.

DISCLOSURE OF THE INVENTION

The present invention contemplates a barrier structure in two sections, mounted vertically above the rear portion of a stoker grate. Each section of the barrier structure is formed of a carrier bar having the same configuration as the carrier bar of the stroker grate, with keys mounted thereon with the same configuration as the keys of the stoker grate. The first of the two barrier sections is mounted rigidly to the furnace tubes. The second section is mounted to pivot, both sections together presenting a unitary impact surface for fuel and trash projected from the front of the grate. The pivoted barrier section normally rests the ends of its keys on the surface of the stoker grate and pivots to accommodate the cyclic changes of vertical distance between the furnace and the grate surface.

Other objects, advantages and features of this invention will become apparent to one skilled in the art upon consideration of the written specification, appended claims, and attached drawings.

BEST MODE FOR CARRYING OUT THE INVENTION

Introduction

An all-pervading desire, with the present invention, is to provide an impact surface above the horizontal surface of a stoker grate which will control the flight of projected material destined to be deposited upon the upper surface of the grate. Additionally, this surface is to be provided by structure having the same configuration as the structure of the grate. The result is that units of grate structure are readily available as replacements for the embodiment of the invention. Of course, it might be highly desirable to have the inventive embodiment made of material selected to specifically withstand the violence and abuse stemming from cannonading of hurtling solid trash caught up in the solid fuel. On the other hand, it may be acceptable to utilize precisely the units of replacement grate parts in this service. There are other problems solved by the arrangement provided for this barrier structure, but high on the list of priorities is the potential use of precisely the same keys originally destined for the grate of the stoker.

The disclosure will present the embodying barrier in two sections. Both sections will be given a common mounting so that certain spatial relationships between them will be maintained over the cyclic dimensional variations of furnace heating and cooling. The one section will be mounted to pivot in a way that will enable its lower edge to follow the vertical dimensional variation between the stoker grate surface and the furnace tubes suspended above it. Additionally, a limit will be placed upon the pivoting to avoid deterioration and destruction of the barrier and the grate during certain portions of the thermal cycle of the furnace. Beyond these foregoing generalizations, additional valuable arrangements will be disclosed, discussed, and claimed.

The Furnace, The Stoker, and the Backstop

Figure 1:
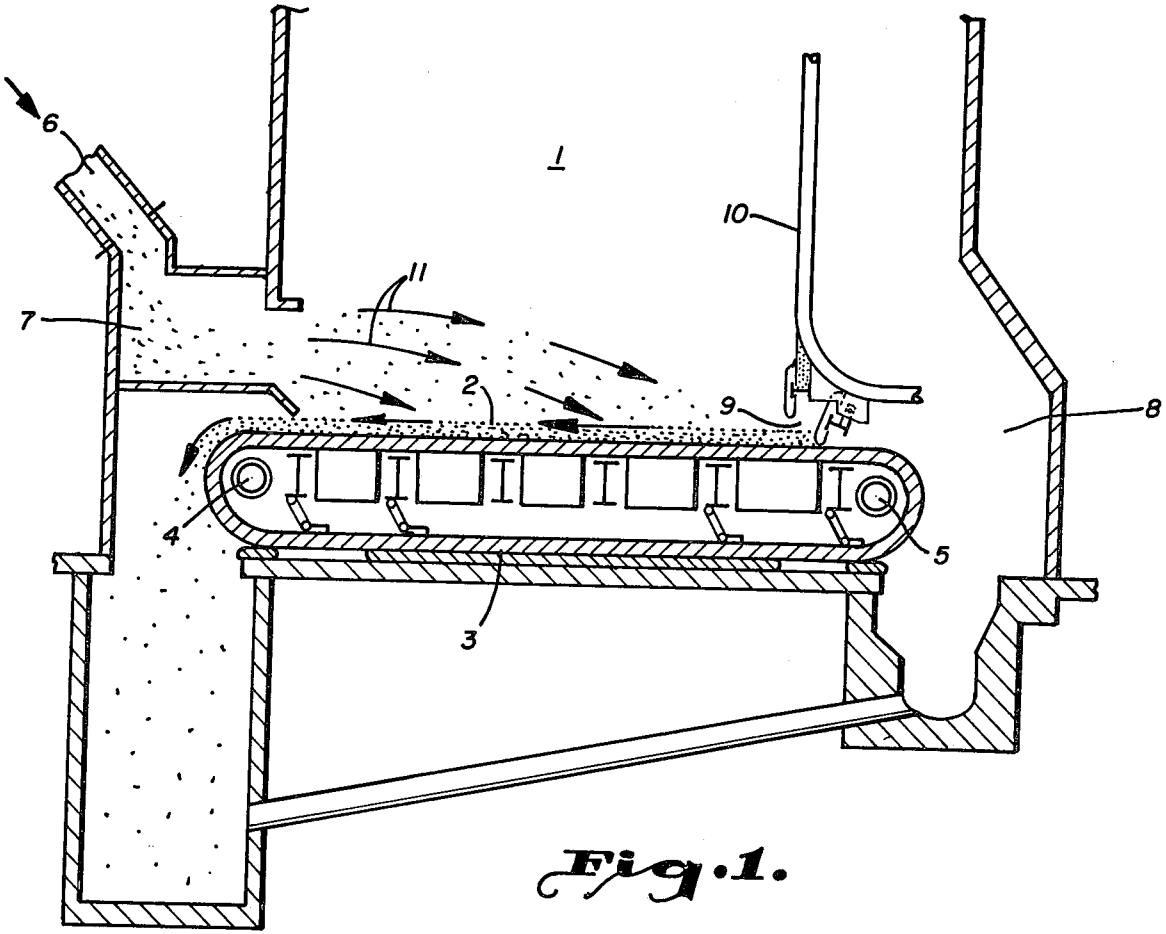
FIG. 1 is a sectioned side elevation of the large portion of the furnace and stoker grate to locate the position of the barrier structure in which the present invention is embodied.

FIG. 1 is designed to help one skilled in the art orient the embodiment of the invention in its environment. The sectioned elevation of FIG. 1 discloses a portion of the towering tubes comprising the furnace 1 extending vertically above the stoker. The stoker is a source of heat, which heat rises and is soaked up by the water circulating in the tubes of the furnace 1. In the environment of the present invention, this heat is obtained from the combustion of solid fuel formed into a burning bed 2 resting on the upper surface of a grate formed by an endless belt 3 supported between roller 4 and roller 5. The solid fuel in the actual reduction to practice was wood. It serves no purpose to dwell on the sources of this wood, other than to point out that solid trash, such as bricks, cement blocks, scrap iron, etc. may not be properly cleaned from the source and end up as projectiles hurtling across the stoker grate. The wood fuel may be supplied from a source and directed as indicated by arrow 6 and disbursed by mechanism 7 onto the bed 2 of stoker grate 3.

It is imperative that the solid wood fuel be projected onto the bed 2. Ideally, this fuel is deposited near the far end of the grate from the projection apparatus 7, ignited as it becomes a part of bed 2 and moves forward to the fuel projection apparatus 7. Thus, for the length of the grate, a combusting bed 2 is continuously formed to deliver its heat upward to the tubes of furnace 1. However, a problem arises with the scrap, trash, and foreign material, which is solid but noncombustible, being propelled at the same time as the wood is deposited on the far end of the grate. Because it is compact, solid, and of high density, this undesirable trash is often shot at some point between the tubes of the back wall of the furnace and the upper surface of the grate. In addition to the mechanical damage caused by this fusillade of solid material, the material may end up in the rear area 8 and cause a myriad of problems because of its accumulation. The present invention provides an impact surface extending vertically above the rear portion of the stoker grate and the back wall of furnace tubes. This structure is generally indicated at 9 and is the focal point of the present disclosure.

The Stationary and Pivoted Sections of the Backstop

Figure 2:
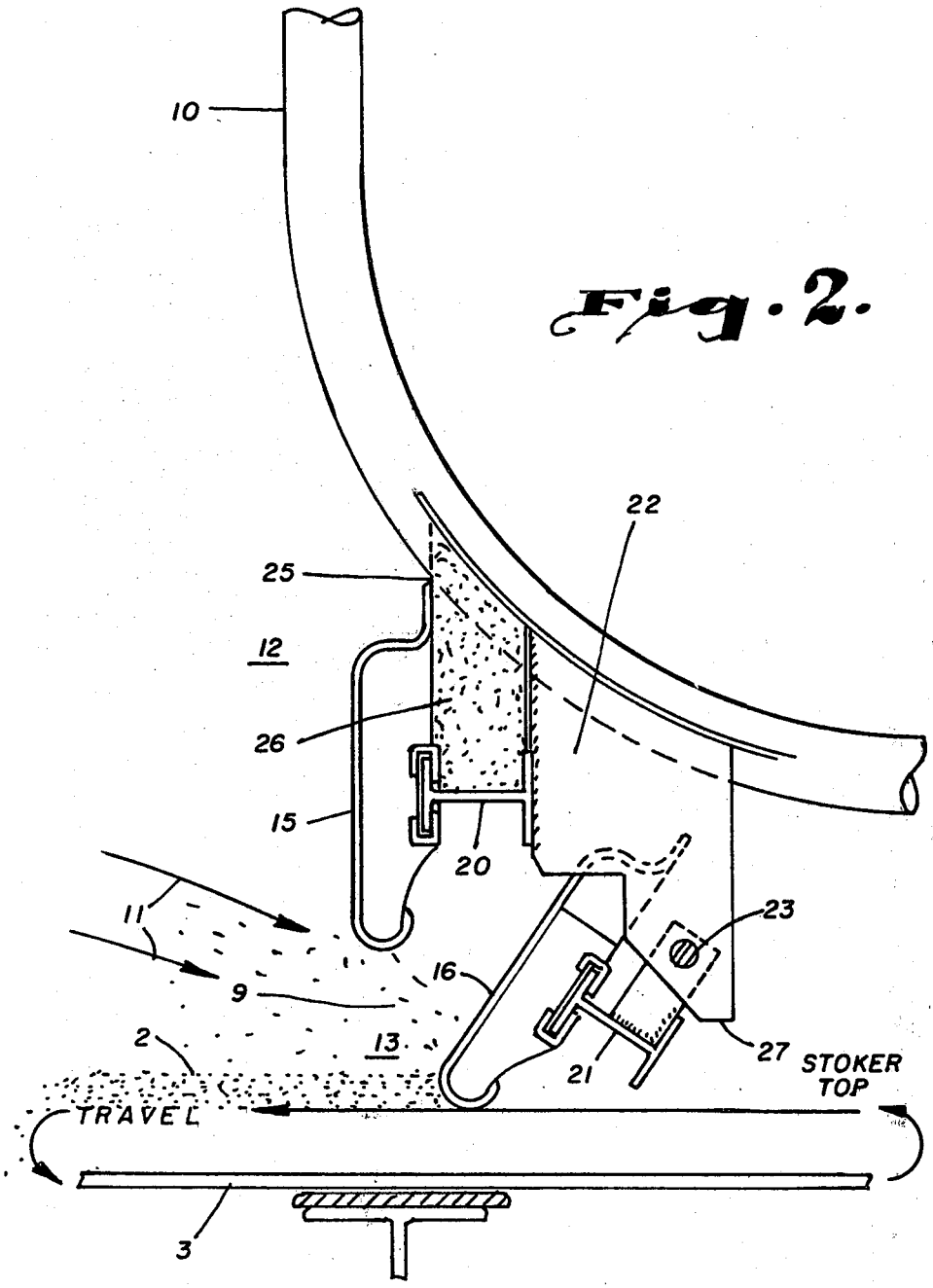
FIG. 2 is an enlarged portion of FIG. 1 to disclose additional details of the barrier structure and its relationship to the furnace tubes and stoker grate.

FIG. 2 discloses the embodiment of the invention which is designated in FIG. 1 at 9. In FIG. 2, this structure is greatly enlarged in a sectioned elevation to disclose how both the stationary and pivoted sections of the backstop 9 are suspended from furnace tubes 10 and above the upper surface of grate 3 on which the bed 2 is burning. Furnace tubes 10 comprise what is usually referred to as the back wall of furnace 1. These tubes are arranged side-by-side and welded together, the weld material being referred to as a membrane. Fortunately, this membrane is a convenient anchor for suspending the backstop sections so that their impact surfaces are effectively presented to the oncoming projectiles out of the feed apparatus 7 disclosed in FIG. 1. To dramatize the function of these impact surfaces, arrows 11 indicate the path of this solid trash coming against the impact surface of stationary backstop section 12 and pivoted backstop section 13.

Figure 3:
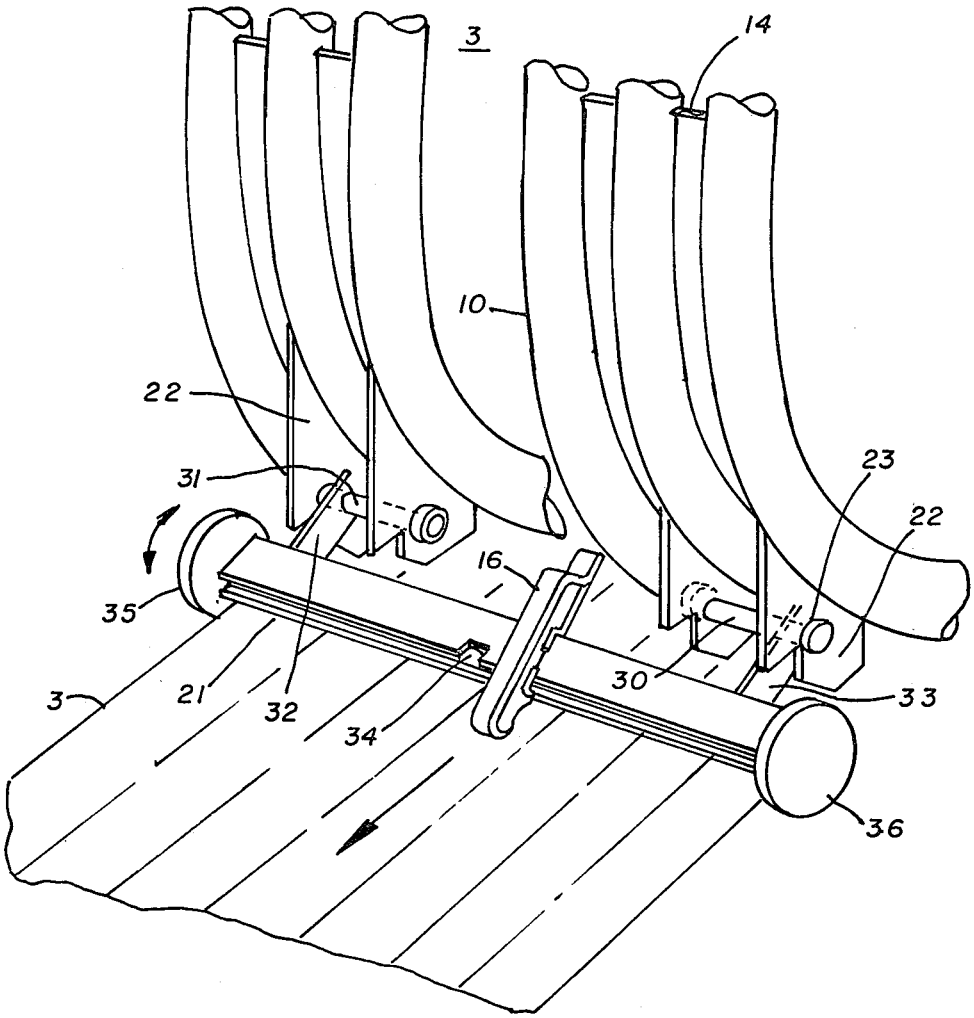
FIG. 3 is an isometric elevation of a portion of the structure of FIG. 2 partially obsured in other views.

It is appropriate at this point, to shift attention to FIG. 3. FIG. 3 shows the furnace tubes 10 forming the back wall of the furnace, welded together by membrane 14. In this FIG. 3, backstop section 12 has been removed in order to see more clearly how the pivoted backstop section 13 is related to the membranes to which it is anchored.

Returning to FIG. 2, a further understanding must be gained as to how the actual impact surface of the backstop is formed. In backstop section 12, the impact surface is provided by keys 15. Of course, only one of these section keys is shown in FIG. 2. The same holds true for keys 16 of pivoted backstop section 13. More about these keys later.

Next, it must be appreciated that each backstop section is built around a carrier bar. This carrier bar 20 of stationary backstop section 12 appears in cross-section in FIG. 2 with the configuration of an I-beam. Correspondingly, carrier bar 21 of the pivoted backstop section 13 also has the configuration of an I-beam. It is upon these carrier bars that the keys 15 and 16 are mounted side-by-side to form the impact surface which is the raison d'etre of the inventive embodiment.

The precise mounting for the two backstop sections may take various forms. The common denominator of these forms is that they are all connected to the membrane structure between tubes 10. In FIG. 2, a support lug 22 is a plate welded directly to the membrane and forms a base for carrier bar 20, as well as a pivoting structure 23 for carrier bar 21. Even at this early stage of the disclosure, it can be appreciated that the backstop section 13 is pivoted from structure 23 and extends down into contact with the upper surface of the grate 3 during normal operation of furnace 1. Therefore, the projectiles following the paths indicated by arrows 11 "see" only the impact surfaces of both backstop sections 12 and 13.

Stationary Backstop Section 12

One of the broad concepts of the invention is to provide a backstop of two sections coordinating on their mounting to provide a unitary impact surface for material projected along paths 11. In one sense, this broad concept does not depend upon how, or from what, the two sections of the backstop are mounted. They are simply mounted between the lower end of the back wall formed by tubes 10 and the upper surface of the grate 3. However, there are secondary considerations it is well to note.

In FIG. 2, carrier bar 20 is the base of the stationary backstop portion as the carrier bar is mounted to lug plate 22. By means of a centrally located notch along the length of carrier bar 20, the keys 15, all together providing the impact surface of section 12, are engaged, or mounted, on the bar. In FIG. 2, only the end view of a single one of the keys is viewed. Its companion keys are strung along the length of the bar 20 and extend upward to contact, or substantially contact, their tubes 10.

This arrangement of keys leaves a series of scalloped apertures at 25 which cannot be seen in the convention of FIG. 2. Nevertheless, a material is placed behind this panel of keys to seal this scalloped opening along the upper edges of the aligned keys. A body of refractory 26 is provided to fill this void. All of the necessary plates to provide a chamber for this refractory 26 are attached to lug plate 22. When assembled, as disclosed in FIG. 2, the refractory body 26, carrier bar 20, and the keys 15 mounted thereon, form a fixed impact surface extending from the tubes 10 down toward the surface of the grate below.

The Pivoted Backstop Section 13

This structure "fills in" the space between the lower end of section 12 and the surface of the stoker grate. Under the broad concept of coordinating with section 12 to provide the unitary backstop surface against which paths 11 projectiles impact, section 13 pivots as required to stay in contact with the surface of the stoker grate. Again, stoker keys 16 are ganged side-by-side to provide the impact surface of section 13. But, in this case, the support of these keys is pivoted at 23 as the vertical distance varies between the furnace tubes and the surface of the grate.

As with the first backstop section 12, a carrier bar 21 is extended horizontally to support the keys. A lug member is attached to the carrier bar and extends back to point 23. Pivot point 23, as previously stated, is mounted on lug plate 22 to maintain the spatial relationship constant between the two backstop sections.

The lower end of the keys of bar 21 normally ride upon the moving surface of the grate. By normal is meant during the combustion of bed 2. With the heat of bed 2 bringing the furnace tubes 10 up to working temperature, the entire furnace structure is elongated a certain distance downward until the lower end of the keys of this pivoted section drag on the surface of the moving grate. As the load on the furnace varies, the distance varies between the furnace tubes and grate, and the section 13 of the backstop pivots to maintain the lower ends of its keys in contact with the grate surface.

When the furnace is shut down, i.e., there is no combusting bed 2, the cooled furnace tubes 10 retreat vertically upward. It would be disasterous if pivoted section 13 were allowed to pivot counter-clockwise until the lower toes of the keys would engage the grate surface. The damage would be that when the furnace is started up and the furnace tubes 10 elongated downwardly, the keys would be dug into the grate surface until something gave. The obvious result would be breakage of the keys on both backstop and grate by this crushing downward force. Therefore, a limit is placed on the counter-clockwise pivoting of section 13 by stop 27 so that when the furnace is brought back into service, the lower ends of the keys will be brought back into non-destructive engagement with the surface of the grate.

It is now time to return to FIG. 3 where carrier bar 21 is shown suspended from the membrane of tubes 10. FIG. 3 frees the understanding of FIG. 2 arrangement to more clearly observe carrier bar 21 in its full length. Further, it can be seen that the lug plate 22 of FIG. 2 is certainly not the lone support of the carrier bars. In FIG. 3, lug plates 22 are shown as two pairs of plates firmly connected to the membranes between tubes 10. Each pair has a bolt journaled through holes in the lug plates to form the pivot of the carrier bar 21. Pivot 23 is, in reality, embodied in bolt 30 and bolt 31. Carrier bar 21 has two lug plates 32 and 33 which connect carrier bar 21 to the bolts 30 and 31. The detail of this structure could be more specifically delineated, but doing so would not serve the purpose of clearly disclosing the invention within its broad concepts.

FIG. 3 has not been completed in a showing of the stationary section of the backstop. The delineation of this stationary structure, and removal of the keys from carrier bar 21, gives a picture of the suspension of carrier bar 21 which cannot be gleaned from FIG. 2. A single one of keys 16 is disclosed in place on carrier bar 21 as threaded thereon through notch 34. The ends of the row of keys are held on bar 21 by the end stops 35 and 36. At the mid-point of the bar, the adjoining keys are cotter-pinned, or otherwise secured, to complete the impact surface of keys 16.

Figure 4:
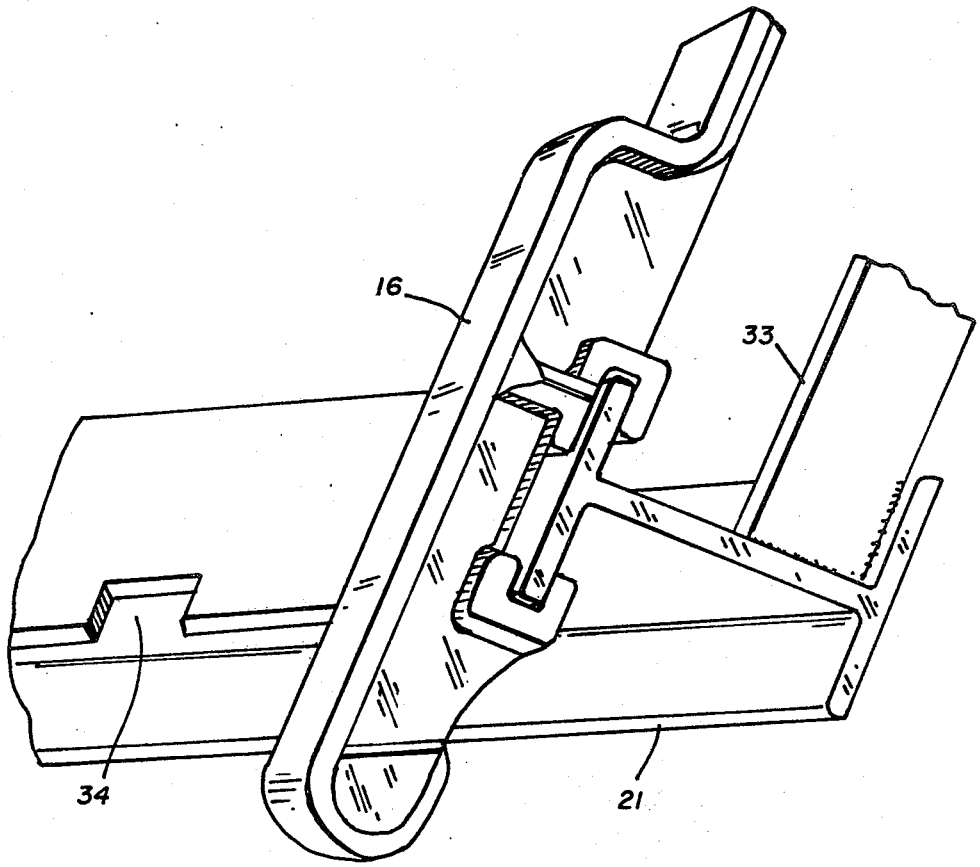
FIG. 4 is an isometric elevation of a single key and its relationship to its carrier bar.

FIG. 4 is an enlarged view of the single key 16 of FIG. 3 and its relation to carrier bar 21 on which it is mounted. It is expected that this key has the same configuration as those keys available for the stoker grate. Their mounting on the carrier bars within the stoker grate is well established in the art. To utilize a similar configuration for the keys embodying the present invention means that any broken keys in the barrier can be replaced from the stock of such keys for the stoker.

Of course, special metals may be utilized for both the carrier bars, the keys, and the mounting lugs to embody the invention. The material selected for these structures respond to economics and is not of direct importance to a disclosure of the invention. Again, the invention provides the impact surfaces with the series of stoker keys 15 and 16 having the individual configuration disclosed in FIG. 4. These surfaces are provided by the two sections, the stationary section extending its key 15 surface substantially vertical from the furnace tubes on which they are mounted, and the pivoted section extending its key 16 surface at an angle and a distance from the stationary section which will prevent the projectiles of paths 11 from being propelled past the grate structure.

For whatever it is worth, the keys form a porous structure through which the combustion air passes to enter into the combustion process of the bed on the stoker grate.

Summation or Conclusion

Step-by-step, the disclosure has defined the environment for the invention at the rear portion of a moving grate structure. Means for propelling solid fuel toward this rear end of the grate is mounted at the front end of the grate. The objective is to deposit a supply of solid fuel on the rear end of the grate so that as this fuel is ignited and forms a bed on the grate, it will be carried the length of the upper surface of the grate to generate the heat absorbed by the water in the furnace tubes suspended above the grate. The problem met by the present invention is caused by the fact that the solid fuel has foreign, non-combustible material propelled along with the solid fuel. These foreign objects strike with destructive force against the grate and furnace. A barrier must be raised against this material to form a protective impact surface.

It is a concept of the present invention to mount a protective barrier from the furnace tubes extending over the grate surface. Specifically, the barrier structure will be connected to the membrane of welded material between the furnace tubes. Under the present concept, the barrier is to be suspended in two sections, the first section being stationary and the second section being pivoted so that its lower end will have drag-contact with the grate surface and extend upward in overlapping relationship with the first section.

The stationary first section 12 will extend its impact surface of keys 15 vertically downward a finite distance, while the second pivoted section 13 will extend its impact surface of keys 16 at an angle from a mounting below the first section. Together, the impact surfaces of the two sections are spaced from each other to form a unitary impact surface to the solid, foreign material propelled toward the back of the grate.

An important feature of the two sections of the barrier is that each section is formed by extending a horizontal carrier bar transverse the line of grate movement and mounting a series of grate keys on these bars. Forming the impact surface with grate keys enables maintenance, repair and replacement with the standard grate key from stocks originally anticipated for the grate, itself. Further, the barrier surface provided by grate keys in the well-known configuration of the grate, itself, enables the combustion air to flow through the resulting porous barrier structure in supporting combustion of the bed.

The pivoted section of the barrier is provided a positive stop member which limits the downward movement of the grate-contacting end of the barrier. This arrangement provides that when the furnace tube mounting structure for the barrier is carried upward by the contracting furnace tubes, the contact end of the second section of the barrier will not be left to dangle downward to subsequently dig into and destructively contact the surface of the grate when the furnace tubes again elongate. Of course, the contraction and expansion of the furnace tubes is caused by the cyclic firing of the furnace from the ignited combustion bed.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. In a solid-fuel burning furnace utilizing a moving grate stoker and having a fuel supply propelling solid fuel toward the rear of the moving grate of the stoker, including, a stoker grate having the configuration of an endless belt on supporting parallel and horizontal rollers, a fuel supply means mounted at the front end of the stoker to propel the solid fuel toward the rear end of the grate, a back furnace wall having parallel water tubes extending vertically over the grate and joined to each other by welding as a membrane, a first impact surface extending vertically downward from the furnace tubes over the rear portion of the grate, and a second impact surface extending at an angle to the horizontal beneath the first impact surface to engage the grate surface in completing a barrier to the solid fuel discharged toward the rear of the grate.

2. The structure of claim 1, in which, the two impact surfaces are provided structures mounted in suspension from the furnace tubes.

3. The combination of claim 2, in which, the impact surfaces are provided by keys having the configuration of keys forming the grate surface.

4. The combination of claim 1, including, pivot structure for the second impact surface arranged to enable the second impact surface to pivot in a vertical plane as the vertical distance between the furnace tubes and grate surface varies.

5. The pivot structure of claim 4, including, a stop structure to limit the clockwise pivoting range of the second impact surface when the furnace is out of service.

6. In a furnace having water-cooled walls as tube panels suspended over a moving grate on which a combusting bed is advanced from the rear of the furnace toward the front of the furnace a barrier structure, including, a first stationary section comprising a carrier bar fixed to the furnace tubes above the rear portion of the grate surface on which are mounted a row of grate keys which together form an impact surface facing the front of the furnace to shield the grate and furnace structure from the impact of non-combustible solid projectiles, a second section of the barrier comprising a carrier bar mounted to pivot from the furnace tubes above the grate on which keys are mounted to provide an impact surface extending from overlap with the impact surface of the first section down to the grate surface, and means for limiting the pivoting range of the second barrier section to prevent the lower end of the second section from destructive contact with the grate surface.

* * * * *